United States Patent [19]

Casey

[11] Patent Number: 4,544,076

[45] Date of Patent: Oct. 1, 1985

[54] LOCKING CAP FOR OIL STORAGE TANK

[76] Inventor: Don W. Casey, P.O. Box 736, Great Bend, Kans. 67530

[21] Appl. No.: 663,175

[22] Filed: Oct. 22, 1984

[51] Int. Cl.[4] ..... B65D 55/14; B65D 45/23

[52] U.S. Cl. ..... 220/210; 70/164

[58] Field of Search ..... 220/210, 314; 70/159, 70/232, 158, 1, 164, 171

[56] References Cited

U.S. PATENT DOCUMENTS 4,030,628 6/1977 Hippert, Jr. ..... 220/210

4,186,843 2/1980 Omori ..... 220/210

*Primary Examiner*—George T. Hall

*Attorney, Agent, or Firm*—Harvey B. Jacobson

[57] ABSTRACT

A lock is provided for use in conjunction with a large volume storage tank of the type including an access opening having an outstanding peripheral flange extending thereabout and a pivoted cap swingable into and out of position closing said opening from the outer edges of said flange. The lock includes a mount stationarily mounted relative to the tank slightly outwardly of one marginal portion of the aforementioned peripheral flange and defining a recess opening outwardly of the mount in a direction generally paralleling the plane of the aforementioned opening. A locking body is provided including a first portion removably lengthwise telescopingly receivable in the recess and a second portion positioned in closely spaced overlying relation with the outer surface of the cap when the first portion is telescoped into the recess to thereby prevent swinging of the cap from the closed position toward the open position thereof. Lock structure is provided for releasably locking the body in position with the first portion telescoped into the recess.

8 Claims, 5 Drawing Figures

FIG. 1
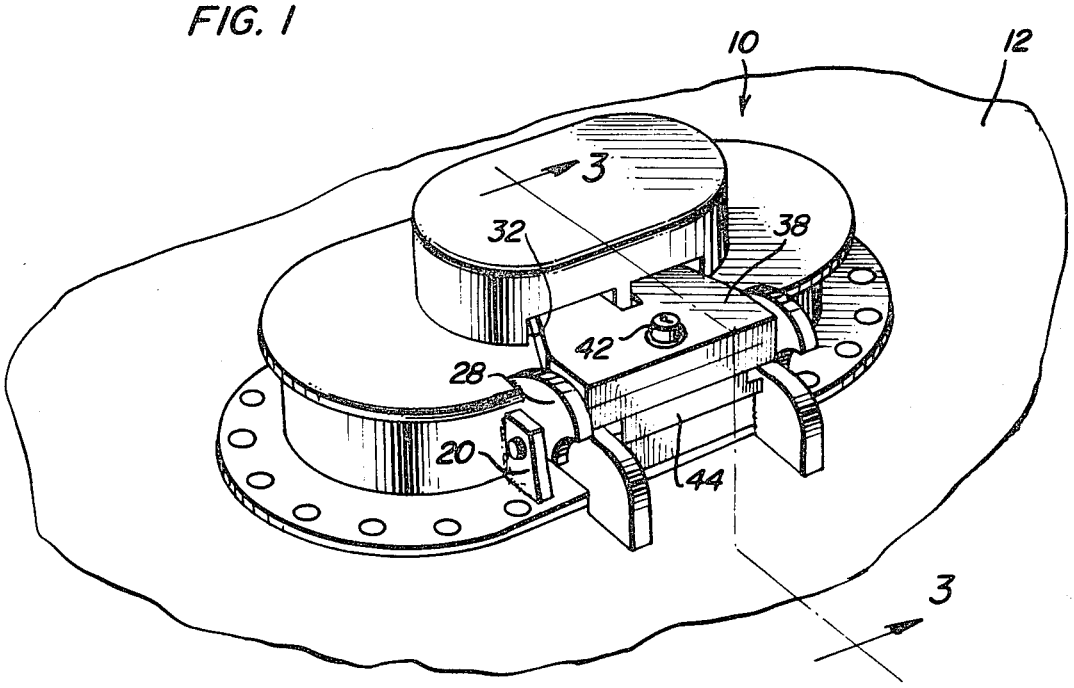
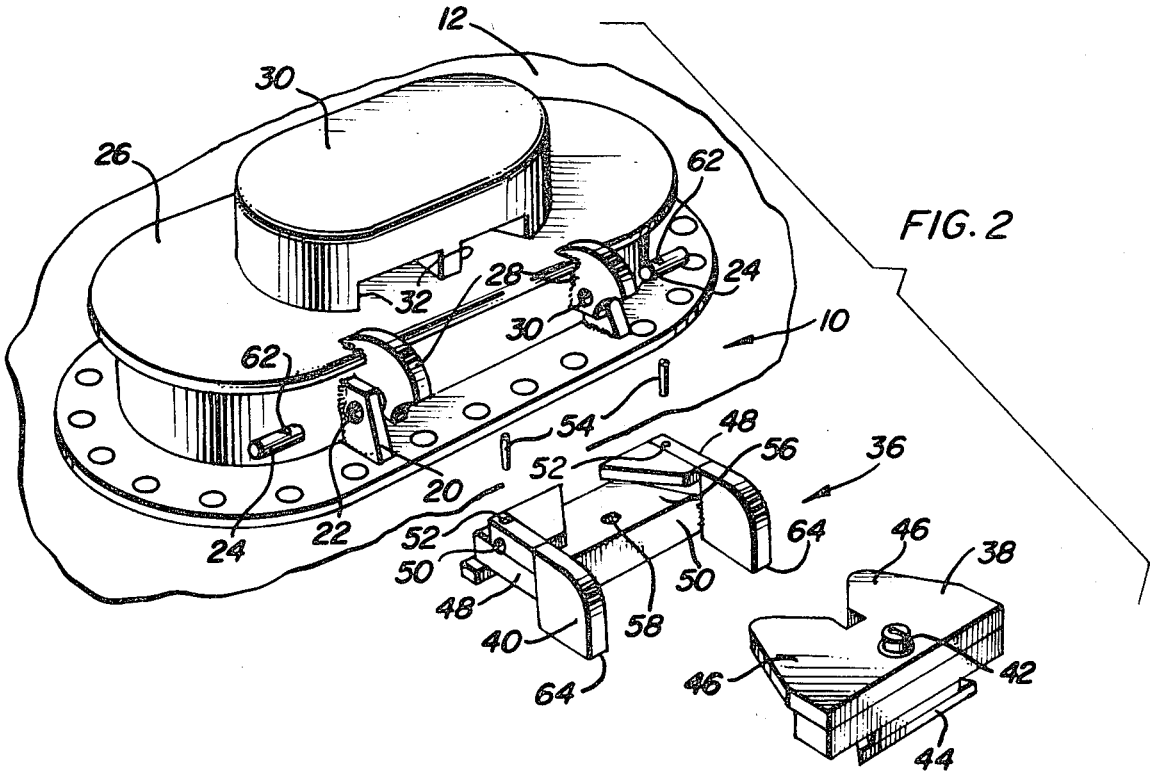
FIG. 2

LOCKING CAP FOR OIL STORAGE TANK

BACKGROUND OF THE DISCLOSURE

1. Field of the Invention

A lock construction is provided for securely locking the hinged cap for the fill opening of an oil storage tank in the closed position in order as an effective deterrent against unauthorized removal of oil from oil storage tanks.

2. Description of the Prior Art

Oil storage tanks of large volume are conventionally provided with upwarding facing fill or access openings having upstanding flanges extending peripherally thereabout and closure caps are hingedly mounted from the tanks for swinging movement between closed positions closely overlying the flanges and open positions swung upwardly and away from the flanges and disposed to one side thereof. Various structures are utilized for removably locking such caps in closed positions, but conventional locking means have in the past not proven effective against unauthorized persons wishing to take oil from the storage tanks. Accordingly, a need exists for a means by which a hinged closure cover for an oil storage tank may be effectively releasably locked in a closed position.

Various different forms of locking caps and closures including some of the general structural and operational features of the instant invention are disclosed in U.S. Pat. Nos. 1,747,202, 1,778,989, 1,944,535, 4,023,386 and 4,313,321.

However, these previously known forms of locking devices are not specifically adapted for use in conjunction with the oil storage tank closure caps for which the locking cap structural of the instant invention has been specifically designed.

SUMMARY OF THE INVENTION

The locking cap of the instant invention incorporates a conventional hinged closure cap, but is inclusive of locking structure comprising a base portion terminally mounted upon an associated tank and a locking portion interlockingly engageable with the base portion and including an area of locking portion which overlies the associated closure cap when the latter is in the closed position in order to prevent movement of the closure cap to the open position thereof. Further, the locking structure incorporates a locking mechanism which may not be readily tampered with in a manner effective to unlock the associated cap.

The main object of this invention is to provide a hinged closure cap locking mechanism which may be used in conjunction with the hinged caps of oil storage tanks of large volume to effectively lock those caps against swinging from the closed postions thereof to the open positions thereof.

Another object of this invention is to provide a mechanism which will be capable of operative association with existing pivoted closure caps and which incorporates structure for facilitating easy secure locking of the associated locking cap in a closed position.

A further important object of this invention is to provide a locking cap which may be readily operatively associated with an existing oil storage tank through the utilization of conventional hand tools and which does not require any power tools or welding processes for effective mounting in operative association with a storage tank.

Still another object of this invention is to provide a locking cap for an oil storage tank including structural features thereof which will strongly resist tampering by persons wishing to take oil from an oil storage tank in an unauthorized manner.

A final object of this invention to be specifically enumerated herein is to provide a locking cap for oil storage tanks in accordance with the preceding objects and which will conform to conventional forms of manufacture, be of simple construction and easy to install and be used so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the upper portion of an oil storage tank and an associated closure cap for closing an access opening in the tank and with the cap locking structures of the instant invention operatively associated with the cap to prevent unauthorized opening;

FIG. 2 is a perspective view similar to FIG. 3 but illustrating the cap-locking mechanism in exploded position;

DESCRIPTION OF THE PREFERRED EMBODIMENT

Figure 3:
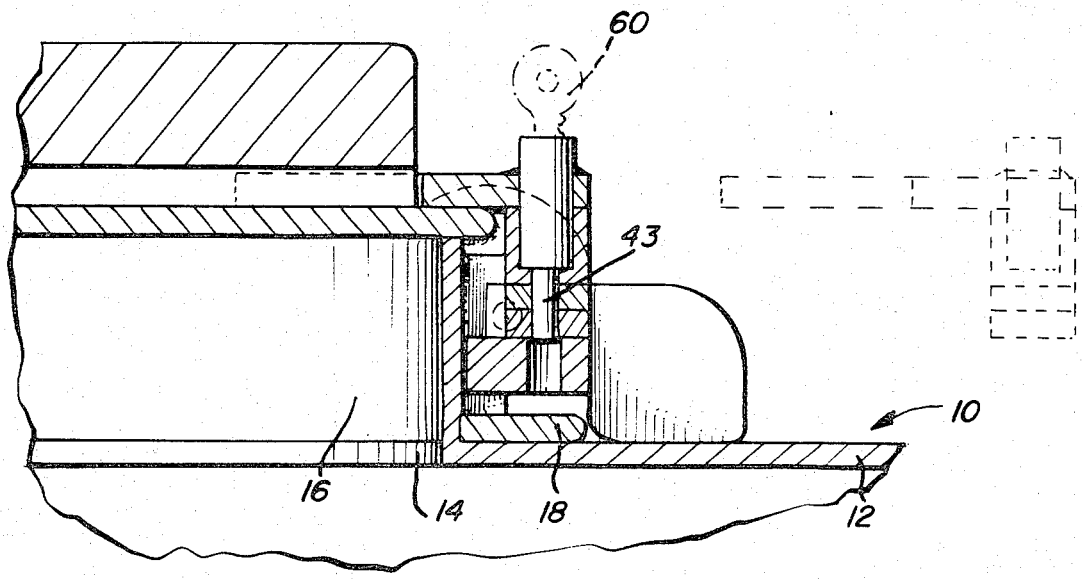
FIG. 3 is an enlarged fragmentary vertical sectional view taken substantially upon the plane indicated by the section line 3—3 of FIG. 1.
Figure 4:
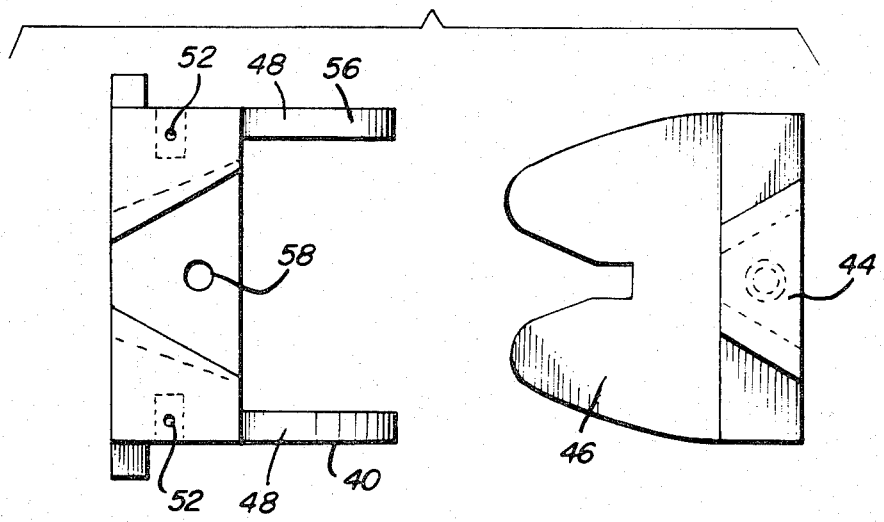
FIG. 4 is a top plan view of the cap-locking mechanism.
Figure 5:
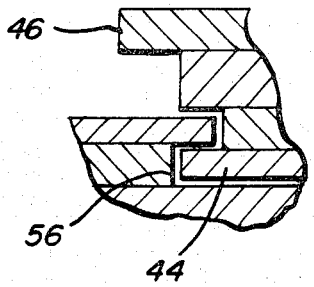
FIG. 5 is a fragmentary enlarged sectional view illustrating the manner in which the upper portion of the cap-locking mechanism may be keyed in position relative to the stationarily mounted lower portion of the locking mechanism in order to securely anchor the upper portion of the locking mechanism in locked position relative to the associated closure cap.

Referring now more specifically to the drawings, the numeral 10 generally designates a large volume oil storage tank incorporating a top wall portion 12 having a fill and/or access opening 14 formed therein.

The tank 10 further includes an outstanding peripherally continuous flange 16 mounted thereon about the periphery of the opening 14 and the flange 16 includes an annular mounting flange 18 overlying and secured to the portion of the top wall portion 12 disposed about the opening 14.

A pair of mounting brackets 20 are secured, as by welding, to the upper surface of the mounting flange 18 and the outer surface of the peripherally continuous flange 16 along one longitudinally straight portion thereof and the mounting brackets 16 include aligned bores 22 formed therein in which the remote ends of a pair of pivot pins 24 are rotatably received.

A closure cap 26 is provided and is in the form of a horizontal plate of generally the same plan shape as the peripherally continuous flange 16, but the closure cap 26 is of greater longitudinal and transverse dimensions for closing against the upper end of the peripherally continuous flange 16 in overlapped engagement therewith. The closure cap includes a pair of outstanding lug portions 28 depending downwardly therefrom and snugly received between the mounting brackets 28. The lug portions 28 include registered apertures 30 through which intermediate length portions of the pivot pins 24 are received and in this manner the closure cap 26 is hingedly supported from the tank 10 for swinging movement between a closed position closely overlying and abutting the upper surfaces of the peripherally continuous flange 16 and a raised out-of-the-way position disposed outwardly of the side of the peripherally continuous flange 16 from which the mounting brackets 20 are supported.

The upper surface of the closure cap 26 includes a dome 30 secured thereto and the dome 30 has a pair of horizontally outwardly facing recesses or openings formed therein which open in a direction facing outwardly of the portion of the peripherally continuous flange 16 from which the mounting brackets 20 are supported.

The lock assembly of the instant invention is referred to in general by the reference numeral 36 and includes first and second portions 38 and 40. The first portion 38 includes a vertically disposed key-operated lock assembly 42 of conventional design opening upwardly through the upper surface of the portion 38 and the lock assembly 42 is of the type including a downwardly projectable locking pin 43. In addition, the lower portion of the portion 38 includes a dependingly supported inverted T-shaped and tapering head 44. Also, the portion 38 includes a pair of horizontally outwardly projecting upper tongue portions 46 for a purpose to be hereinafter more fully set forth.

The second portion 40 includes a pair of opposite side structures 48 interconnected by a bridging member 50 extending and secured therebetween and the opposite side structures include axially spaced aligned bores 50 as well as vertically disposed locking pin bores 52 intersecting with the bores 50 and in which locking pins 54 may be removably received. The opposite side portions 48 and the bridging member 50 together define an outwardly opening and inwardly tapering recess 56 in which the head 44 is removably seatingly engageable to key the first portion 38 to the second portion 40 and the bridging member 50 includes a vertical bore 58 formed therein in which the lower end of the locking pin 43 is receivable when downwardly projected relative to the first portion 38 upon operation of the lock assembly 42 by the appropriate key 60.

The opposite side portions 48 are receivable between the lugs or lug portions 28 with the bores 50 registered with the apertures 30 and the bores 22 and the pivot pins 24 are insertable through each set of bores 22 and 50 and the corresponding aperture 30 and retained in position by the pins 54, the lower ends of the latter being received in upstanding bores 62 formed in the pivot pins 24. The side of the second portion 40 which opposes the peripheral continuous flange 16 is closely juxtaposed the latter and the outer under surfaces 64 of the opposite side portions 48 abut downwardly upon the upper surface of the top wall 12 closely outwardly of the mounting flange 18. In this manner, the second portion 40 is securely anchored relative to the tank.

After the closure tank 26 has been swung to the closed position thereof illustrated in FIG. 2 of the drawings, the first portion 38 is advanced toward the second portion 40 with the head 44 being seatingly engageable in the recess 56 and the tongue portions 46 closely overlying the adjacent portions of the closure cap 26 and received within the openings 32. Then, the key operated lock assembly 42 is actuated to downwardly displace the locking pin 44 for reception in the vertical bore 58. Once the first portion 38 has thus been secured in position, it is impossible for the closure cap 26 to be opened.

It will be noted that the lock assembly 36 may be readily retrofitted to existing tanks provided with the structural features illustrated in FIG. 2 of the drawings in non-exploded position. Actually, the dome 30 may be omitted, but the provision of the dome 30 prevents the free ends of the tongue portions 46 from being upwardly bent through the utilization of a crowbar or other similar tool. Thus, the dome 30 substantially increases the difficulty encountered by a person attempting unauthorized access to the interior of the tank 10.

As hereinbefore set forth, the recess 56 tapers inwardly and in this manner the head 44 may be seated within the recess 56 in order to establish the inner position of movement of the first portion 38 toward the closure cap 26. Of course, when the head 44 is fully seated within the recess 56, the locking pin 43 is registered with the bore 58 formed in the bridging member 50 of the second portion 40.

It will also noted that the only thing required to retrofit the lock assembly 36 to an existing tank and hinged cap is to provide the structure illustrated in exploded positions in FIG. 2 of the drawings with the pins 24 being utilized to replace previous pivot pin structure (not shown) utilized to pivotally mount the lugs 28 from the mounting brackets 20. Further, when the cover 26 is locked closed, the pins 54 are fully covered by the first portion 38.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a storage tank including a fill opening and a hinged cap for said fill opening and whereby an outstanding peripheral flange extends about and projects outwardly from said opening, a pair of stationary mounting portions spaced along and disposed outward of one marginal portion of said flange, said cap including a pair of lug portions mounted from one marginal portion thereof and pivotally supported from said mounting portions by a pivot shaft means extending through said lug portions and said mounting portions for swinging of said cap about an axis extending between said mounting portions between a closed position overlying the outer marginal of said peripheral flange and an open position disposed outwardly of and to one side of said opening, a cap lock, said lock including a mount stationarily mounted between said mounting portions and said lug portions by said pivot shaft means and defining a recess opening outwardly thereof in a direction generally paralleling the plane of said opening, a locking body including a first portion removably lengthwise telescopingly receivable in said recess and a second portion positioned in closely spaced overlying relation with the outer surface of said cap when said first portion is telescoped into said recess preventing swinging of said cap from said closed position to said out position, and lock means releasably locking said body in position with said first portion telescoped into said recess.

2. The combined storage tank, hinged cap and lock of claim 1 wherein the outer surface of said cap includes a dome secured thereover, said dome including an opening facing outwardly thereof in said direction and in which said second portion is telescoped into when said first portion is telescoped into said recess.

3. The combined tank, cap and lock of claim 1 wherein said pivot shaft means includes a pair of axially spaced and aligned pivot pins each mounting a corresponding lug portion from an associated mounting portion, the adjacent ends of said pivot pins being received in bores formed in said mount.

4. The tank, cap and lock combination of claim 1 wherein said recess tapers inwardly and said first portion includes a complementary taper for seating engagement of said first portion in said recess.

5. The tank, cap and lock combination of claim 1 wherein said cap is of generally the same plan shape as said peripheral flange extending about said opening, but is slightly larger in dimension than the plan area of said flange so as to extend outwardly beyond all marginal portions of said flange.

6. The tank, cap and lock combination of claim 5 wherein the outer surface of said cap includes a dome secured thereover, said dome including an opening facing outwardly thereof in said direction and in which said second portion is telescoped into when said first portion is telescoped into said recess.

7. The tank, cap and lock combination of claim 6 wherein said pivot shaft means includes a pair of axially spaced and aligned pivot pins each mounting a corresponding lug portion from an associated mounting portion, the adjacent ends of said pivot pins being received in bores formed in said mount.

8. The tank, cap and lock combination of claim 7 wherein said recess tapers inwardly and said first portion includes a complementary taper for seating engagement of said first portion in said recess.

* * * * *